US005516444A

United States Patent [19]

Gaines et al.

[11] Patent Number: 5,516,444

[45] Date of Patent: May 14, 1996

[54] SYNERGISTIC COMBINATIONS FOR USE IN FUNCTIONAL FLUID COMPOSITIONS

[75] Inventors: Lewis H. Gaines, Allentown, Pa.; William H. Stover; William R. Thompson, both of Sarnia, Canada

[73] Assignee: Exxon Chemical Patents Inc, Linden, N.J.

[21] Appl. No.: 322,842

[22] Filed: Oct. 13, 1994

[51] Int. Cl.[6] ..... C01L 1/22; C01M 133/44; C01M 133/58

[52] U.S. Cl. ..... 252/51.5 A; 44/347

[58] Field of Search ..... 252/51.5 A; 44/347

[56] References Cited

U.S. PATENT DOCUMENTS

| | | | |
|---|---|---|---|
| 2,568,876 | 9/1951 | White et al. | 252/51.5 A |
| 3,004,987 | 10/1951 | Paris et al. | 252/51.5 A |
| 3,216,936 | 11/1965 | LeSuer | 252/32.7 |
| 3,247,110 | 4/1966 | Gee et al. | 252/51.5 A |
| 3,382,172 | 5/1968 | Lowe | 252/42.7 |
| 3,458,444 | 7/1969 | Shepherd et al. | 252/51.5 A |
| 3,458,530 | 7/1969 | Siegel et al. | 252/51.5 A |
| 3,544,467 | 12/1970 | Kautsky | 252/51.5 |
| 3,753,905 | 8/1973 | Souillard et al. | 252/51.5 A |
| 3,955,940 | 5/1976 | Hollyday | 44/62 |
| 4,100,082 | 7/1978 | Clason et al. | 252/51.5 A |
| 4,325,827 | 4/1982 | Papay et al. | 252/51.5 A |
| 4,326,987 | 4/1982 | Hendricks et al. | 252/51.5 A |
| 4,613,341 | 9/1986 | Zaweski et al. | 44/57 |
| 4,659,492 | 4/1987 | Jahnke | 252/49.3 |
| 4,705,643 | 11/1987 | Nemo | 252/51.5 A |
| 4,714,561 | 12/1987 | Hoke | 252/51.5 A |
| 4,780,111 | 10/1988 | Dorer et al. | 44/71 |
| 4,997,594 | 3/1991 | Walsh | 252/51.5 A |
| 5,122,616 | 6/1992 | Malfer | 548/546 |
| 5,156,654 | 10/1992 | Koch et al. | 44/331 |
| 5,176,840 | 1/1993 | Campbell et al. | 252/49.6 |
| 5,225,093 | 7/1993 | Campbell et al. | 252/51.5 A |
| 5,330,667 | 7/1994 | Tiffany, III et al. | 252/51.5 A |

FOREIGN PATENT DOCUMENTS

| | | | |
|---|---|---|---|
| 0020037A1 | 12/1980 | European Pat. Off. | C01M 1/36 |

*Primary Examiner*—Jerry D. Johnson
*Attorney, Agent, or Firm*—John J. Mahon

[57] ABSTRACT

The present invention provides functional fluid compositions containing a major portion of oil of lubricating viscosity and a novel and synergistic combination of an acylated nitrogen-containing compound having an oil soluble olefinic substituent averaging in carbon number from 8 to 20 and at least one ashless detergent/dispersant.

4 Claims, No Drawings

SYNERGISTIC COMBINATIONS FOR USE IN FUNCTIONAL FLUID COMPOSITIONS

BACKGROUND OF THE INVENTION

1. Field of the Invention

This invention relates to improved functional fluid compositions, more particularly to improved water-cooled two-cycle engine oil compositions which satisfy certain engine performance demands and, desirably, are environmentally friendly.

2. Description of Related Art

There are many situations in which oleaginous compositions are released into the environment. Among the ways these releases occur include leaks, accidental discharges, spills, and waste effluent. Unfortunately, the effects of these releases typically lead to undesirable environmental problems. In water-cooled two-cycle engine applications, these effects may include harm to aquatic life, most notably, fish.

Today's two-cycle engine designs have placed severe demands on the engine's lubricants. Lessening ring sticking and piston deposits by providing a cleanly burning and detergent/dispersant effective fuel/oil mixture are among the key demands to be satisfied. These demands, coupled with environmental pollution concerns, provide a formidable challenge to the formulator. Desirably, a single lubricant composition is sought to meet both engine performance and environmental demands. The functional fluid compositions of this invention offer one response toward satisfying these demands.

SUMMARY OF THE INVENTION

This invention relates to a functional fluid composition comprising a major amount of lubricating oil and a detergent/dispersant effective and/or non-toxic effective amount of an additive combination of:

(I) an acylated nitrogen-containing compound of:

(a) a carboxylic acylating agent prepared by reacting (i) at least one oil soluble olefinic or haloolefinic hydrocarbyl compound averaging in carbon number from 8 to 20, and (ii) an alkenyl mono- or polycarboxylic acid or acid producing compound where the alkenyl is α, β to the carboxylic group; and (b) a nitrogen-containing compound having at least one primary or secondary amine group; and (II) at least one ashless detergent/dispersant.

Other embodiments of this invention include a concentrate containing the above additive combination and a lubricant-fuel mixture comprising a fuel and a minor portion of the combination. Yet another embodiment is a method of providing detergency/dispersancy and lessening toxicity of a functional fluid composition by incorporating this invention's additive combination.

The advantages of this invention's synergistic combination of (I) and (II) include providing compositions which not only meet the severe demands placed on the engine's lubricants, but also surprisingly improve environmental friendliness by reducing the toxicity of these compositions.

DETAILED DESCRIPTION OF THE INVENTION

Component I: Acylated Nitrogen-Containing Compounds

Suitable acylated nitrogen-containing compounds are formed by reacting a carboxylic acylating agent and a nitrogen-containing compound having at least one primary or secondary amine group.

(a) Carboxylic Acylating Agent

The carboxylic acylating agent is prepared by reacting at least one oil soluble olefinic or haloolefinic hydrocarbyl compound with at least one alkenyl mono- or polycarboxylic acid or acid producing compound where the alkenyl is α, β to the carboxylic group. Although the hydrocarbyl compound ranges in carbon number averaging from $C_8$–$C_{20}$, it preferably averages from $C_{14}$–$C_{20}$, most preferably from $C_{16}$–$C_{18}$.

For purposes of this invention, carbon number ranges referred to throughout the specification are intended to indicate number averages with the understanding that the range may contain substituents with actual carbon numbers above or below the specified range.

Additionally, for purposes of this invention, the term oil soluble is meant to include compounds which are totally, substantially, or partially soluble in oil over a wide temperature range, especially low temperatures (e.g., –25° C.).

The oil soluble $C_8$–$C_{20}$ olefinic hydrocarbyl compounds include branched olefins and/or linear olefins whose solubility has been enhanced by double-bond or skeletal isomerization. For purposes of this invention, double-bond isomerization is meant to designate isomerization in which the double bond has been randomly distributed along the length of the olefin. The term skeletal isomerization is meant to signify isomerization which results in a rearrangement of the olefin's carbon chain from a linear to branched configuration.

Thus, the oil soluble $C_8$–$C_{20}$ olefin may be branched, linear, isomerized linear oligomers, or any combination thereof. Among the preferred branched olefins are the highly branched $C_8$–$C_{15}$ propylene or propylene/butylene oligomers made by the UOP Corporation's well-known phosphoric acid catalysed process. Preferred branched olefins of this type are $C_{12}$ propylene tetramers, diisobutylene, and oligomers of isobutylene.

Other suitable branched olefins are those prepared by polymerizing lower olefins (i.e., $C_2$–$C_{10}$ range, either by themselves or in combination) using acid or metal alkyl catalyst systems well known in the art.

$C_8$–$C_{20}$ linear olefins may be produced by oligomerization of lower olefins (especially ethylene), paraffin dehydrogenation, or wax cracking. For purposes of this invention, the term linear olefin is meant to encompass olefins which are predominantly linear or moderately branched because the production of the linear olefins typically forms a small amount of moderately branched olefins.

Included among the preferred linear or moderately branched olefins are the $C_{14}$–$C_{20}$, most preferably the $C_{16}$–$C_{18}$ α-olefins which have undergone double-bond isomerization.

Double-bond isomerization of the linear olefins can be carried out using conventional methods. One suitable method is to heat the olefins with an acidic catalyst. Especially useful acid catalysts are sulfonic acids such as methane or toluene sulfonic acid and the sulfonated styrene-divinylbenzene copolymers. Also suitable acid catalysts are $BF_3$ and $BF_3.H_3PO_4$. Such catalysts are commercially available and are conventionally used as cation exchange resins. Typical resins are Amberlyst 15, XN-1005 and XN-1010 (registered trademarks) available from Rohm and Haas Company. Use of such resins for double-bond isomerization of linear α-olefins is described in U.S. Pat. No. 4,108,889, incorporated herein by reference.

Skeletal isomerization of the linear olefins can be accomplished using methods known in the art. Typically, these methods employ acidic catalysts mostly prepared from an alumina support with some surface modification by halogen-containing compounds, such as hydrogen bromide or butyl bromide. Such methods and improved methods for skeletal isomerization are described in U.S. Pat. Nos. 5,321,193 and 5,198,590, the disclosures of which are incorporated herein by reference.

The $C_8$–$C_{20}$ olefins may be treated with halogens, such as chlorine or bromine, to make haloolefinic compounds which are more reactive toward the alkenyl carboxylic acids or their derivatives described as follows.

Suitable alkenyl mono- or polycarboxylic acid or acid producing compounds useful in this invention are those in which the alkenyl group is α, β to the carboxylic group. Examples of these compounds include acrylic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, crotonic acid, methyl-crotonic acid, sorbic acid, 3-hexenoic acid, 10-decenoic acid, and the like. Due to considerations of economy and availability, the acid reactants usually employed are acrylic acid, methacrylic acid, maleic acid, and maleic anhydride. Most preferred is maleic acid or maleic anhydride.

The preparation of carboxylic acylating agents is well known in the art. For example, when using an olefinic polymer, the olefinic polymer and maleic acid or maleic anhydride may be simply heated together as disclosed in U.S. Pat. Nos. 3,361,673 and 3,401,118 to cause a thermal "ene" reaction to take place. Or the olefinic polymer can first be halogenated, for example, chlorinated or brominated to about 1 to 8 wt. %, preferably 3 to 7 wt. % chlorine or bromine, based on the weight of polymer, by passing the chlorine or bromine through the polyolefin at a temperature of 60° to 250° C., e.g., 120° to 160° C., for about 0.5 to 10 hours, preferably 1 to 7 hours. The halogenated polymer may then be reacted with sufficient maleic acid or maleic anhydride at 100° to 250° C., usually about 180° to 235° C., for about 0.5 to 10 hours, e.g., 3 to 8 hours, so that the product obtained will contain the desired number of moles of succinic acid or succinic anhydride per mole of the halogenated polymer. Processes of this general type are described in U.S. Pat. Nos. 3,087,936, 3,172,892, 3,272,746 and others.

Alternatively, the olefinic polymer and the maleic acid or maleic anhydride are mixed and heated while adding chlorine to the heated mixture. Processes of this type are disclosed in U.S. Pat. Nos. 3,215,707, 3,231,587, 3,912,764, 4,110,349, and in U.K. 1,440,219.

By the use of a halogen, about 65 to 95 wt. % of the polyolefin, e.g., polyisobutylene, will normally react with the maleic acid or maleic anhydride. When carrying out a thermal reaction without the use of a halogen or a catalyst, usually only about 50 to 75 wt. % of the polyisobutylene will react. Chlorination helps increase the reactivity between the polyolefin and the maleic acid or maleic anhydride.

The carboxylic acylating agents contain an average number of mono- or polycarboxylic acid or acid producing compounds per olefinic compound from about 5 to 1, preferably from 3 to 1, and most preferably 1.

(b) Nitrogen-Containing Group

The nitrogen-containing group of the acylated nitrogen-containing compound is derived from compounds characterized by a radical having the structural configuration >NH. The two remaining valences of the nitrogen atom preferably are satisfied by hydrogen, amino, or organic radicals bonded to the nitrogen atom through direct carbon-to-nitrogen linkages. Thus, the compounds from which the nitrogen-containing group may be derived include principally ammonia, aliphatic amines, aromatic amines, heterocyclic amines, or carbocyclic amines. The amines may be primary or secondary amines and may also be polyamines such a alkylene amines, arylene amines, cyclic polyamines, and the hydroxy-substituted derivatives of such polyamines.

Specific amines of these types are methylamine, N-methyl-ethylamine, N-methyl-octylamine, N-cyclohexyl-aniline, dibutylamine, cyclohexylamine, anilene, di(p-methyl)amine, dodecylamine, octadecylamine, o-phenylenediamine. N,N'-di-n-butyl-p-phenylenediamine, morpholine, piperazine, tetrahydropyrazine, indole, hexahydro-1,3,5-triazine, 1-H-1,2,4-triazole, reelamine, bis-(p-aminophenyl)methane, phenylmethyleneimine, methanediamine, cyclohexamine, pyrrolidine, 3-amino-5,6-diphenyl1, 2,4-triazine, ethanolamine, diethanolamine, quinonediimine, 1,3-indandiimine, 2octadecylimidazoline, 2-phenyl-4-methyl-imidazolidine, oxazolidine, 2-heptyloxazolidine, N-amino-propyl-morpholine, and dimethyl-amino-propyl-amine.

A preferred source of the nitrogen-containing group are polyamines, especially alkylene amines conforming for the most part to the formula

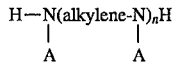

wherein n is an integer preferably less than about 10, A is a substantially hydrocarbon or hydrogen radical, and the alkylene radical is preferably a lower alkylene radical having less than about 8 carbon atoms. The alkylene amines include principally methylene amines, ethylene amines, butylene amines, propylene amines, pentylene amines, hexylene amines, heptylene amines, octylene amines, other polymethylene amines, and also the cyclic and the higher homologues of such amines such as piperazines and amino-alkyl-substituted piperazines. They are exemplified specifically by: ethylene diamine, triethylene tetramine, propylene diamine, decamethylene diamine, octamethylene diamine, di(heptamethylene)triamine, tripropylene tetramine, tetraethylene pentamine, trimethylene diamine, pentaethylene, hexamine, di(trimethylene)-triamine, 2-heptyl-3-(2-aminopropyl)imidazoline, 4-methyl-imidazoline, 1,3-bis(2-aminoethyl)imidazoline, pyrimidine, 1-(2-aminopropyl)piperazine, 1,4-bis(2-aminoethyl)piperazine, 2-methyl-1-(2-aminobutyl)piperazine, and mixtures thereof. Higher homologues such as are obtained by condensing two or more of the above-illustrated alkylene amines likewise are useful. Examples of mixed cyclic and acylic polyamines are described in U.S. Pat. No. 5,171,466, the disclosure of which is incorporated herein by reference.

The ethylene amines are especially useful. They are described in some detail under the heading "Ethylene Amines" in "Encyclopedia of Chemical Technology" Kirk and Othmer, volume 5, pages 898–905, Interscience Publishers, New York (1950). Such compounds are prepared most conveniently by the reaction of an alkylene chloride with ammonia. The reaction results in the production of somewhat complex mixtures of alkylene amines, including cyclic condensation products such as piperazines. These mixtures find use in the process of this invention. On the other hand, quite satisfactory products may be obtained also by the use of pure alkylene amines. An especially useful alkylene amine for reasons of economy as well as effectiveness of the products derived therefrom is a mixture of ethylene amines prepared by the reaction of ethylene chloride and ammonia and having a composition which corresponds to that of tetraethylene pentamine or the so-called "polyamine bottoms" resulting from polyethyleneamine synthesis which contains predominately pentaethylene hexamine and tetraethylene pentamine and a lesser amount of lighter ethylene polyamines and cyclic condensation products containing piperazine rings.

Hydroxyalkyl-substituted alkylene amines, i.e., alkylene amines having one or more hydroxyalkyl substituents on the nitrogen atoms, likewise are contemplated for use herein. The hydroxyalkyl-substituted alkylene amines are preferably those in which the alkyl group is a lower alkyl group, i.e., having less than about 6 carbon atoms. Examples of such amines include N-(2-hydroxyethyl)ethylene diamine, N,N'-bis(2-hydroxyethyl)ethylene diamine, 1-(2-hydroxyethyl) piperazine, mono-hydroxypropyl substituted diethylene triamine, 1,4-bis(2-hydroxypropyl)-piperazine, dihydroxypropyl-substituted tetraethylene pentamine, N-(3-hydroxypropyl) tetramethylene diamine, and 2-heptadecyl-1(2-hydroxyethyl)imidazoline.

Higher homologues such as are obtained by condensation of the above-illustrated alkylene amines or hydroxy alkyl-substituted alkylene amines through amino radicals or through hydroxy radicals are likewise useful. It will be appreciated that condensation through amino radicals results in a higher amine accompanied with removal of ammonia and that condensation through the hydroxy radicals results in products containing ether linkages accompanied with removal of water.

Other sources of the nitrogen-containing group include ureas, thioureas, hydrazines, guanidines, amidines, amides, thioamides, cyanamides, etc. Specific examples illustrating such compounds are: hydrazine, phenylhydrazine, N,N'-diphenylhydrazine, octadecylhydrazine, benzoylhydrazine, urea, thiourea, N-butylurea, stearylamide, oleylamide, guanidine, 1,3-diphenylguanidine, 1,2,3-tributylguanidine, benzamidine, octadecamizine, N,-N'-dimethylstearamidine, cyanamide, dicyandiamide, guanylurea, aminoguanidine, etc. Of course, it will be appreciated by those skilled in the art that some of the foregoing nitrogen-containing compounds will more readily react with the carboxylic acylating agent than others.

(c) Preparation of Acylated Nitrogen-Containing Compounds

Although both alkenyl mono- or polycarboxylic acid or acid producing compounds are useful in this invention, the polycarboxylic acid or acid producing compounds, such as succinic acids or anhydrides, are particularly useful. When the succinic compounds are used, the nitrogen-containing group in the acylated nitrogen compositions of this invention is characterized by a nitrogen atom attached directly to the succinic radical. It will be appreciated, of course, that the linkage between the nitrogen atom and a succinoyl radical is representative of an amide or an imide structure, that the linkage that forms between a nitrogen atom and succinimido radical is representative of an amidine structure, and that the linkage between a nitrogen atom and succinoyloxy radical is representative of an ammonium-carboxylic acid salt structure. Thus, the preferred acylated nitrogen compounds used in this invention are characterized by amide, amide-salt, imide, amidine, or salt linkages and in many instances a mixture of such linkages.

A convenient method for preparing the preferred acylated nitrogen-containing compounds comprises reacting a succinic acid-producing compound characterized by the presence within its structure of at least one oil soluble olefin and at least one succinic acid-producing compound and illustrated by one having the structural configuration:

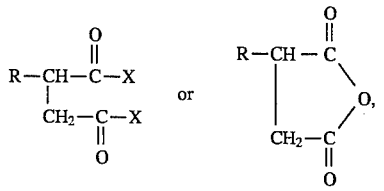

wherein R is a substantially hydrocarbon radical having at least one oil soluble $C_8$–$C_{20}$ olefin and X is selected from the class consisting of halogen, hydroxy, hydrocarbonoxy, and acyloxy radicals, with at least about one-half an equivalent amount of a nitrogen-containing compound characterized by the presence within its structure of at least one radical having the structural configuration:

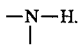

The foregoing process involves a reaction between the succinic acid-producing compound with the nitrogen-containing radical to result in the direct attachment of the nitrogen atoms to the succinic radical, i.e., succinoyl, succinimidoyl, or succinoyloxy radical. The linkage formed between the nitrogen atom and the succinic radical may thus be that representative of a salt, amide, imide, or amidine radical. In most instances the product of the above process contains a mixture of linkages representative of such radicals. The precise relative proportions of such radicals in the product usually are not known as they depend to a large measure upon the type of the acid-producing compound and the nitrogen-containing radical involved in the reaction and also upon the conditions (e.g., temperature) in which the reaction is carried out. The reaction involving an acid or anhydride compound with an amino nitrogen-containing radical at relatively low temperatures such as below about 60° C. results predominantly in a salt linkage, illustrated as follows:

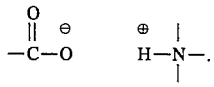

However, at relatively high temperatures such as above about 80° C., the reaction results predominantly in an amide, imide, or amidinc linkage, shown respectively below:

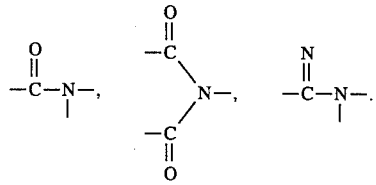

In any event, however, the products obtained by the above process, irrespective of the nature or relative proportions of the linkages present therein, have been found to be effective as additives in hydrocarbon oils for the purposes of this invention.

The aliphatic hydrocarbon-substituted succinic acids and anhydrides are especially preferred for use as the acid-producing reactant of this process for reasons of the particular effectiveness of the products obtained from such compounds as additives in hydrocarbon oils. The succinic compounds are readily available from the reaction of maleic anhydride with an oil soluble $C_8$–$C_{20}$ olefin or a chlorinated hydrocarbon such as the olefinic oligomer described hereinabove. The reaction involves merely heating the two reactants at a temperature about 100°–200° C. The product from such a reaction is an alkenyl succinic anhydride. The alkenyl group may be hydrogenated to an alkyl group. The anhydride may be hydrolyzed by treatment with water or steam to the corresponding acid. Either the anhydride or the acid may be converted to the corresponding acid halide or ester by reaction with, e.g., phosphorus halide, phenols, or alcohols.

In lieu of the olefins or chlorinated hydrocarbons, other hydrocarbons containing an activating polar substituent, i.e., a substituent which is capable of activating the hydrocarbon molecule in respect to reaction with maleic acid or anhydride, may be used in the above-illustrated reaction for preparing the succinic compounds. Such polar substituents may be illustrated by sulfide, disulfide, nitro, mercaptan, bromine, ketone, or aldehyde radicals. Examples of such polar-substituted hydrocarbons include polypropene sulfide, di-polyisobutene disulfide, nitrated mineral oil, di-polyethylene sulfide, brominated polyethylene, etc. Another method useful for preparing the succinic acids and anhydrides involves the reaction of itaconic acid with an isomerized $C_8$–$C_{20}$ olefin or a polar-substituted hydrocarbon at a temperature usually within the range from about 100° to about 200° C.

The acid halides of the succinic acids can be prepared by the reaction of the acids or their anhydrides with a halogenation agent such as phosphorus tri-bromide, phosphorus pentachloride or thionyl chloride. The esters of such acids can be prepared simply by the reaction of the acids or their anhydrides with an alcohol compound such as methanol, ethanol, octadecanol, cyclohexanol, etc., or a phenolic compound such as phenol, naphthol, octylphenol, etc. The esterification is usually promoted by the use of an alkaline catalyst such as sodium hydroxide or sodium alkoxide or an acidic catalyst such as sulfuric acid. The nature of the alcoholic or phenolic portion of the ester radical appears to have little influence on the utility of such ester as a reactant in the process described hereinabove.

The nitrogen-containing reactants useful in preparing the acylated nitrogen-containing compounds have been described previously in this specification, with the most useful being the ethylene polyamines and their mixtures.

Preparation of the acylated nitrogen-containing compounds is usually carried out by heating a mixture of the acid-producing compound and the nitrogen-containing reactant at a temperature above about 80° C., preferably within the range from about 100° C. to about 250° C. However, when an acid or anhydride is employed in reactions with an amino nitrogen-containing reactant, the process may be carried out at a lower temperature such as room temperature to obtain products having predominantly salt linkages or mixed salt-amide linkages. Such products may be converted, if desired, by heating to about 80° C. to products having predominantly amide, imide, or amidine linkages. The use of a solvent such as benzene, toluene, naphtha, mineral oil, xylene, n-hexane, or the like is often desirable in the above process to facilitate the control of the reaction temperature and removal of water.

The relative proportions of the acid-producing compounds and the nitrogen-containing reactants to be used in the above process are such that at least about one-half of a stoichiometrically equivalent amount of the nitrogen-containing reactant is used for each equivalent of the acid-producing compound used. In this regard, the equivalent weight of the nitrogen-containing reactant is based upon the number of the nitrogen-containing radicals. Similarly, the equivalent weight of the acid-producing compound is based upon the number of the acid-producing radicals defined by the structural configuration $$-\overset{\overset{\displaystyle O}{\|}}{C}-X.$$

Thus, ethylene diamine has two equivalents per mole; amino guanidine has four equivalents per mole; a succinic acid or ester has two equivalents per mole, etc.

The upper limit of the useful amount of the nitrogen-containing reactant appears to be about two moles for each equivalent of the acid-producing compound used. Such amount is required, for instance, in the formation of products having predominantly amidinc linkages. On the other hand, the lower limit of about one-half equivalent of the nitrogen-containing reactant used for each equivalent of the acid-producing compound is based upon the stoichiometry for the formation of products having predominantly imide linkages or mixed acid-amide linkages. In most instances, the preferred amount of the nitrogen-containing reactant is at least about one equivalent for each equivalent of the acid-producing compound used.

It is also contemplated that the oil soluble $C_8$14 $C_{20}$ acylated nitrogen-containing compounds be after-treated using procedures well known in the art so long as the compositions continue to contain basic nitrogen. Furthermore, contacting of the basic nitrogen-containing compounds with the after-treating compound(s) may be accomplished concurrently or in any sequence. Suitable post-treating compounds include urea, thiourea, carbon disulfide, aldehydes, ketones, carboxylic acids, hydrocarbon-substituted succinic anhydrides, nitriles, epoxides, boron compounds, organic phosphorus compounds, inorganic phosphorus compounds (such as $H_3PO_3$, $H_3PO_4$, etc.), sulfur compounds, or the like, and mixtures thereof.

Component II: Ashless Detergent/Dispersants

A wide variety of ashless detergent/dispersants can be used in this invention. Suitable detergent/dispersants are basic nitrogen compounds which must have a basic nitrogen content as measured by ASTM D-664 or D-2896. They are preferably oil-soluble. Typical of such compositions are succinimides, carboxylic acid amides, hydrocarbyl monoamines, hydrocarbyl polyamines, Mannich bases, phosphoramides, thiophosphoramides, phosphonamides, dispersant viscosity index improvers, and mixtures thereof. These basic nitrogen-containing compounds are described below. Any of the nitrogen-containing compositions may be after-treated using procedures well known in the art so long as the compositions continue to contain basic nitrogen. Aftertreatment may be accomplished by contacting the basic nitrogen-containing compound with the after-treating compound(s) concurrently or in any sequence. Suitable post-treating compounds include urea, thiourea, carbon disulfide, aldehydes, ketones, carboxylic acids, hydrocarbon-substituted succinic anhydrides, nitriles, epoxides, boron compounds, organic phosphorus compounds, inorganic phosphorus compounds (such as $H_3PO_3$, $H3PO_4$, etc.), sulfur compounds or the like, and mixtures thereof. These aftertreatments are particularly applicable to succinimides and Mannich base compositions.

The mono- and polysuccinimides that can be used as a detergent/dispersant in this invention are disclosed in numerous references and are well known in the art. Certain fundamental types of succinimides and the related materials encompassed by the term of art "succinimide" are described in U.S. Pat. Nos. 3,219,666; 3,172,892; and 3,272,746, the disclosures of which are hereby incorporated by reference. The term "succinimide" is understood in the art to include many of the amide, imide, and amidine species which may also be formed. The predominant product however is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 60 to about 350 carbon atoms, and an ethylene amine, said ethylene amines being especially characterized by ethylene diamine, diethylene triamine, triethylene tetramine, and tetraethylene pentamine. Particularly preferred are those succinimides prepared from polyisobutenyl succinic anhydride of about 70 to 128 carbon atoms and tetraethylene pentamine or the so-called "polyamine bottoms" resulting from polyethyleneamine synthesis. These "polyamine bottoms" predominately contain pentaethylene hexamine and tetraethylene pentamine and a lesser amount of lighter ethylene polyamines and cyclic condensation products containing piperazine rings.

Also included within the term "succinimide" are the cooligomers of a hydrocarbyl succinic acid or anhydride and a poly secondary amine containing at least one tertiary amino nitrogen in addition to two or more secondary amino groups. Ordinarily this composition has between 1,500 and 50,000 number average molecular weight ($\overline{M}n$). A typical compound would be that prepared by reacting polyisobutenyl succinic anhydride and ethylene dipiperazine.

Carboxylic acid amide compositions are also suitable detergent/dispersants. Typical of such compounds are those disclosed in U.S. Pat. No. 3,405,064, the disclosure of which is hereby incorporated by reference. These compositions are ordinarily prepared by reacting a carboxylic acid or anhydride or ester thereof, having at least 12 to about 350 aliphatic carbon atoms in the principal aliphatic chain and, if desired, having sufficient pendant aliphatic groups to render the molecule oil soluble with an amine or a hydrocarbyl polyamine, such as the ethylene amines, to give a mono or polycarboxylic acid amide. Preferred are those amides prepared from (1) a carboxylic acid of the formula $R^2COOH$, where $R^2$ is $C_{12}$–$C_{20}$ alkyl or a polyisobutenyl carboxylic acid in which the polyisobutenyl group contains from 64 to 128 carbon atoms and (2) an ethylene amine, especially triethylene tetramine or tetraethylene pentamine or mixtures thereof.

Another class of compounds which are useful as detergent/dispersants in this invention are hydrocarbyl monoamines and hydrocarbyl polyamines, preferably of the type disclosed in U.S. Pat. No. 3,574,576, the disclosure of which is hereby incorporated by reference. The hydrocarbyl group, which is preferably alkyl, or olefinic having one or two sites of unsaturation, usually contains from 9 to 350, preferably from 20 to 200 carbon atoms. Particularly preferred hydrocarbyl polyamines are those which are derived, e.g., by reacting polyisobutenyl chloride and a polyalkylene polyamine, such as an ethylene amine, e.g., ethylene aliamine, diethylene triamine, tetraethylene pentamine, 2-aminoethylpiperazine, 1,3-propylene diamine, 1,2-propylenediamine, and the like.

Another class of compounds useful for supplying basic nitrogen-containing detergent/dispersants are the Mannich base compositions. These compositions are prepared from a phenol or $C_9$–$C_{200}$ alkylphenol, an aldehyde, such as formaldehyde or formaldehyde precursor such as paraformaldehyde, and an amine compound. The amine may be a mono or polyamine and typical compositions are prepared from an alkylamine, such as methylamine or an ethylene amine, such as, diethylene triamine, or tetraethylene pentamine, and the like. The phenolic material may be sulfurized and preferably is dodecylphenol or a $C_{80}$–$C_{100}$ alkylphenol. Typical Mannich bases which can be used in this invention are disclosed in U.S. Pat. Nos. 4,157,309; 3,649,229; 3,368,972; and 3,539,663, the disclosures of which are hereby incorporated by reference. The last referenced patent discloses Mannich bases prepared by reacting an alkylphenol having at least 50 carbon atoms, preferably 50 to 200 carbon atoms, with formaldehyde and an alkylene polyamine $HN(ANH)_nH$ where A is a saturated divalent alkyl hydrocarbon of 2 to 6 carbon atoms and n is 1–10 and where the condensation product of said alkylene polyamine may be further reacted with urea or thiourea. The utility of these Mannich bases as starting materials for preparing lubricating oil additives can often be significantly improved by treating the Mannich base using conventional techniques to introduce boron into the composition.

Another class of compositions useful as detergent/dispersants in this invention are the phosphoramides and phosphonamides such as those disclosed in U.S. Pat. Nos. 3,909,430 and 3,968,157, the disclosures of which are hereby incorporated by reference. These compositions may be prepared by forming a phosphorus compound having at least one P—N bond. They can be prepared, for example, by reacting phosphorus oxychloride with a hydrocarbyl diol in the presence of a monoamine or by reacting phosphorus oxychloride with a difunctional secondary amine and a monofunctional amine. Thiophosphoramides can be prepared by reacting an unsaturated hydrocarbon compound containing from 2 to 450 or more carbon atoms, such as polyethylene, polyisobutylene, polypropylene, ethylene, 1-hexene, 1,3-hexadiene, isobutylene, 4-methyl-1-pentene, and the like, with phosphorus pentasulfide and a nitrogen-containing compound as defined above, particularly alkylamine, alkyldiamine, alkylpolyamine, or an alkyleneamine, such as ethylene diamine, diethylenetriamine, triethylenetetramine, tetraethylenepentamine, and the like.

Another class of nitrogen-containing compositions useful as detergent/dispersants in this invention includes the so-called dispersant viscosity index improvers (VI improvers). These VI improvers are commonly prepared by functionalizing a hydrocarbon polymer, especially a polymer derived from ethylene and/or propylene, optionally containing additional units derived from one or more comonomers such as alicyclic or aliphatic olefins or diolefins. The functionalization may be carried out by a variety of processes which introduce a reactive site or sites which usually has at least one oxygen atom on the polymer. The polymer is then contacted with a nitrogen-containing source to introduce nitrogen-containing functional groups on the polymer backbone. Commonly used nitrogen sources include any basic nitrogen compound, especially those nitrogen-containing compounds and compositions described herein. Preferred nitrogen sources are alkylene amines, such as ethylene amines, alkyl amines, and Mannich bases.

Preferred basic nitrogen compounds for use in this invention are succinimides, carboxylic acid amides, and Mannich bases with succinimides being particularly preferred, especially succinimides having polyisobutenyl substituents having a number average molecular weight between about 700 and about 5000.

Functional Fluid Compositions

The functional fluid compositions of this invention, including any optional compounds, may be blended with other additives to form a fully finished lubricant formulation or a concentrate designed to meet the particular fluid's application.

The lubricants of this invention include crankcase lubricating oils for spark-ignited and compression-ignited internal combustion engines, for use in mobile applications such as automobile and truck engines, marine and railroad diesel engines, etc., and stationary applications such as electric power generators, compressors, pumps, etc. Automatic transmission fluids, transaxle lubricants, gear lubricants, metal-working lubricants, hydraulic fluids and other lubricating oil and grease compositions also can benefit from the incorporation of the additive combinations of this invention. A preferred utility of the compositions of the invention is in two-cycle engine oil compositions, including two-cycle gasoline and diesel water-cooled applications.

As is well known to those skilled in the art, two-cycle engine lubricating oils are often added directly to the fuel to form a mixture of oil and fuel which is then introduced into the engine cylinder. Such lubricant-fuel oil mixtures are within the scope of this invention. Such lubricant-fuel blends generally contain per 1 part of oil about 15–250 parts fuel, typically they contain 1 part oil to about 25–100 parts fuel.

In some two-cycle engines, the lubricating oil can be directly injected into the combustion chamber along with the fuel or into the fuel just prior to the time the fuel enters the combustion chamber. The two-cycle lubricants of this invention can be used in this type of engine.

The fuels used in two-cycle engines are well known to those skilled in the art and usually contain a major portion of a normally liquid fuel such as hydrocarbonaceous petroleum distillate fuel (e.g., motor gasoline as defined by ASTM Specification D-439-73). Such fuels can also contain non-hydrocarbonaceous materials such as alcohols, ethers, organo-nitro compounds and the like (e.g., methanol, ethanol, diethyl ether, methyl ethyl ether, nitromethane). Also within the scope of this invention are liquid fuels derived from vegetable or mineral sources such as corn, alfalfa, shale and coal. Examples of such fuel mixtures are combinations of gasoline and ethanol, diesel fuels, diesel fuels and ether, gasoline and nitromethane, etc. Particularly preferred is gasoline, that is, a mixture of hydrocarbons having as ASTM boiling point of 60° C. at the 10% distillation point to about 205° C. at the 90% distillation point.

Two-cycle fuels also contain other additives which are well known to those of skill in the art. These can include anti-knock agents such as tetra-alkyl lead compounds, lead scavengers such as halo-alkanes (e.g., ethylene dichloride and ethylene dibromide), dyes, cetane improvers, antioxidants such as 2,6-di-tertiary-butyl-4-methylphenol, rust inhibitors such as alkylated succinic acids and anhydrides, bacteriostatic agents, gum inhibitors, metal deactivators, demulsifiers, upper cylinder lubricants, anti-icing agents, and the like. The invention is useful with lead-free as well as lead-containing fuels.

Typical lubrication oil additives include corrosion inhibitors/metal passivators, antioxidants, pour point depressants, extreme pressure additives, viscosity index improvers, friction modifiers, and the like. These additives are disclosed in, for example, "Lubricant Additives" by C. V. Smalheer and R. Kennedy Smith, 1967, pp. 1–11 and in U.S. Pat. No. 4,105,571, the disclosures of which are incorporated herein by reference.

Corrosion inhibitors/metal passivators are used to protect non-ferrous metal components against attack from acidic contaminants in the lubricating oil.

Suitable metal passivators include 1,2,4-triazoles, benzotriazoles, alkyl-substituted benzotriazoles, 5,5'-methylenebisbenzotriazole, tetrahydrobenzotriazole or their derivatives, 2,5-dimercaptothiadiazole and derivatives thereof. Other suitable metal passivators include N,N'-disalicylidene-1,2-cyclohexanediamine and Mannich reaction products of alkyl phenol, aldehyde and polyamine. A particularly suitable alkyl-substituted benzotriazole is tolyltriazole. The metal passivators may be present in the functional fluids with the invention in an amount effective to provide metal passivation.

Anti-wear and lubricity improvers, particularly sulfurized sperm oil substitutes and other fatty acid and vegetable oils, such as castor oil, are used in special applications, such as racing and for very high fuel/lubricant ratios. Scavengers or combustion chamber deposit modifiers are sometimes used to promote better spark plug life and to remove carbon deposits. Halogenated compounds, phosphorus-, phosphorus/sulfur-, molybdenum-, and/or molybdenum/sulfur-containing materials, and mixtures thereof, may be used with this invention.

Lubricity agents such as synthetic polymers (e.g., polyisobutene having a number average molecular weight in the range of about 300 to about 15,000, as measured by vapor phase osmometry or gel permeation chromatography), polyol ether (e.g., poly(oxyethylene-oxypropylene) ethers) and ester oils (e.g., the ester oil described hereinafter) can also be used in the oil compositions of this invention. Natural oil fractions such as bright stocks (the relatively viscous products formed during conventional lubricating oil manufacture from petroleum) can also be used for this purpose.

Solvents also may be included in the functional fluid composition with the additive combination of this invention. Examples of solvents include untreated and hydrotreated napthas, preferably kerosene (i.e., Stoddard solvents).

The additive combination of this invention, when employed in a lubricating oil, is used typically in a minor amount, which is effective to meet engine performance and/or non-toxicity demands of the oil relative to the absence of the additive combination. Additional conventional additives selected to meet the particular requirements of a desired functional fluid service may be included as desired.

Thus, a fully finished lubrication oil formulation may contain about 1 to 50 vol. % active ingredient with the remainder being a lubrication oil basestock. However, the precise types and amounts of active ingredient depends on the particular application. Representative amounts of additives in lubrication oil formulations including the components of this invention's additive combination (Components I and II) are:

| Additive | Broad Range Vol. % | Preferred Range Vol. % |
|---|---|---|
| Component I | 0.5–20 | 0.5–15 |
| Component II | 1–15 | 5–10 |
| Corrosion Inhibitor/ Metal Passivators | 0.0–3 | 0.0–1.5 |
| Antioxidants | 0.0–5 | 0.0–1.5 |
| Anti-Foaming Agents | 0.0–5 | 0.0–1.5 |
| Other Detergent/Dispersants | 0.0–10 | 0.0–8 |
| Anti-Wear Agents | 0.0–5 | 0.0–1.5 |
| Pour Point Depressants | 0.01–2 | 0.01–1.5 |
| Friction Modifiers | 0.0–3 | 0.0–1.5 |
| Lubricity Agents | 0.0–30 | 0.0–20 |
| Solvents | 0.0–50 | 0.0–30 |
| Lubricating Base Oil | Balance | Balance |

A concentrate generally contains a major portion of the additive combination of this invention and other desired additives in solvent and any desired diluent oil. The additive combination and desired additives (i.e., active ingredients), solvent, and diluent are provided in the concentrate in amounts that give a desired concentration in a finished formulation when combined with a predetermined amount of lubrication oil. The collective amounts of active ingredient in the concentrate are typically from about 10 to 90, preferably from about 25 to 75, most preferably from 40 to 60 vol. %, with the remainder of the concentrate being solvent, and any desired amount of diluent.

Lubrication oil basestocks contemplated for use with this invention can be derived from natural lubricating oils, synthetic lubricating oils, or mixtures thereof. In general, the lubricating oil basestock has a viscosity in the range of about 5 to about 10,000 $mm^2/s$ (cSt) at 40° C., although typical applications require an oil having a viscosity ranging from about 10 to about 1,000 $mm^2/s$ (cSt) at 40° C.

However, in certain applications, one skilled in the art may prefer one type of basestock over another or may wish to avoid use of particular basestocks all together when it is known or is likely that use of the basestock has undesirable effects. For example, in two-cycle engine applications where the oil is burned in fuel/oil mixtures, the particular basestock used may form harmful combustion products causing problems such as ring sticking, poor heat transfer, severe engine corrosion, or excessive wear.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g., dodecylbenzenes, tetradecylbenzenes, dinonylbenzenes, di(2-ethylhexyl)benzene, etc.); polyphenyls (e.g., biphenyls, terphenyls, alkylated polyphenyls, etc.); alkylated diphenyl ethers, alkylated diphenyl sulfides, as well as their derivatives, analogs, and homologs thereof, and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof (e.g., the acetic acid esters, mixed $C_3$ to $C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, di-ethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like. Synthetic hydrocarbon oils are also obtained from hydrogenated oligomers of normal olefins.

Silicone-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hex-(4-methyl-2-pentoxy)-disiloxane, poly(methyl)-siloxanes and poly(m-ethylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are directly obtained from a natural source or synthetic source (e.g., coal, shale, or tar sands bitumen) without further purification or treatment. Examples of unrefined oils include a shale oil directly obtained from a retorting operation, a petroleum oil directly obtained from distillation, or an ester directly obtained from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and are often additionally processed by techniques for removal of spent additives and oil breakdown products.

This invention may be further understood from the following examples which contain preferred embodiments and are not intended to restrict the scope of the appended claims.

PREPARATIVE EXAMPLES

This section describes the preparation of three key components used to illustrate this invention.

Component 1 ("C-1"): Isomerized-Octadecenyl Succinimide

Into a 189 liter (50 gallon) stainless steel reactor, charge 62.6 kg. (137.8 lbs.) of double-bond isomerized-octadecenyl succinic anhydride (Dixie Chemical Company, Inc.) and 13.1 kg. (28.8 lbs.) of 150 solvent neutral (S150N) mineral oil. Heat the contents of the reactor to 130° C.±10° C. under a nitrogen atmosphere and stir at a speed of 150 rpm. Charge 15 kg. (33 lbs.) of tetraethylene pentamine (Union Carbide "Ultra High Purity" grade) below the surface of the reactor contents and heat the contents to 160° C.±5° C. Strip with nitrogen for approximately 2½ hours or until water no longer evolves.

Component 2 ("C-2"):950 $\overline{M}n$ Polyisobutenyl Succinimide

Step (a):

Polyisobutenyl succinic anhydride (PIBSA) is prepared by heating a mixture of 100 parts of polyisobutene (PIB) having a number average molecular weight ($\overline{M}n$) of 940 with 13 parts of maleic anhydride to a temperature of about 120° C. 1.05 parts of chlorine gas is then bubbled through the mixture over a period of about 5 hours while the mixture is heated to 220° C. After the 5 hour period the reaction mixture is heat soaked at 220° C. for about 1.5 hours and then stripped with nitrogen for about 1 hour. The resulting PIBSA has an ASTM Saponification Number of 112.

Step (b):

The PIBSA product of step (a) is then aminated by mixing 1500 grams (1.5 moles) of the PIBSA and 1666 grams of S150N lubricating oil (solvent neutral oil having a viscosity of about 150 SSU at 100° C.) in a reaction flask and heating to about 150° C. Then, 193 grams (1 mole) of a commercial grade of polyethylene-amine (PAM) (a mixture of polyethyleneamines averaging about 5 to 7 nitrogen per molecule) is added and the mixture is heated to 150° C. for about 2 hours. Nitrogen stripping follows for 0.5 hours and then cooling to give the final product (PIBSA-PAM). This product has a viscosity of 140 $mm^2/s$ (cSt) at 100° C., a nitrogen content of 2.12 wt. % and contains approximately 50 wt. % PIBSA-PAM and 50 wt. % unreacted PIB and S150N mineral oil.

Component 3("C-3"):Isostearic Acid+950 $\overline{M}n$ Succinic Anhydride +Tetraethylene Pentamine Into a 189 liter (50 gallon) stainless steel reactor, charge 11.0 kg. (24.1 lbs.) of 950 $\overline{M}n$ polyisobutenyl succinic anhydride (Exxon Chemical). Charge 4.5 kg. (9.8 lbs.) of commercial grade isostearic acid (ISA) (approximately 15% of total ISA charge) to the reactor and heat to 90° C. Charge the reactor with 6.9 kg. (15.2 lbs.) of tetraethylene pentamine (Union Carbide, Ultra High Purity) and charge 25.2 kg. (55.4 lbs.) of the remaining ISA. Heat to 150° C. and purge with 40–50 SCMH (20–25 SCFM) of nitrogen. Reflux at 150° C. for approximately 3 hours.

Heat soak and remove water at 180° C. for 4–5 hours until the Total Acid Number (TAN) is between 8–9 mg KOH/g. Vacuum strip the product between 180° to 195° C., gradually increasing the temperature to meet a total/tertiary amine ratio (0.78 to 0.86). Remove water by vacuum stripping for 5 to 8 hours, as necessary. Cool to 95° C. and pump reactor contents out through a 10 micron filter.

ENGINE PERFORMANCE TESTS

Engine performance using this invention's compositions was evaluated according to the procedure outlined by the National Marine Manufacturers Association ("NMMA") TC-WII™ or TC-W3™ OMC 40 hp Test.

Briefly, the testing method evaluates the overall performance of lubricants used in two-cycle spark-ignited, water-cooled outboard engines. Among the performance features evaluated include piston ring sticking, piston deposits, and any unusual wear or damage to any other engine components.

The test is run in an outboard engine test tank on a modified OMC 44.99 cubic inch (737 cc) two-cylinder 40 hp outboard engine. Overall candidate lubricant performance and spark plug fouling are evaluated and compared to a NMMA reference lubricant run simultaneously in a control test engine. After a break-in period, the engines are run on a five (5) minute idle and fifty-five (55) minute wide open throttle (w.o.t.) cycle for seven (7) hours followed by a one (1) hour minimum shutdown or soak period. This procedure is repeated a total of fourteen (14) times resulting in ninety eight (98) hours of actual engine running time.

The pass-fail criteria for this engine test are summarized below:

Piston Ring Rating: The average piston ring sticking rating of top rings of the candidate oil test shall not be lower than 0.6 points below the average rating of the 93738 NMMA reference oil test top ring ratings.

Piston Deposit: The average piston deposit rating for both pistons of the candidate oil test shall not be lower than 0.6 points below the average of both pistons of the 93738 NMMA reference oil test. Piston deposit average is calculated from an equally weighted average of the deposit ratings of both pistons in the following 4 areas:

1. Average of thrust and anti-thrust piston skirt varnish
2. Undercrown deposits
3. Crownland deposits
4. 2nd land deposits Spark Plug Fouling: The candidate oil shall not have more than one more occurrence than the reference oil.

Exhaust Port Blocking: The exhaust port area blocked by deposits shall not be more than ten percent greater for the candidate oil than for the reference oil.

Preignition: The candidate oil shall have no more occurrences than the reference oil.

General Engine Condition: The condition of piston skirts, bearings and bearing journals of the candidate oil test shall be similar to or better than the reference oil test.

The six test formulations (F-1 to F-5) of Table 1 demonstrate the effectiveness of this invention's additive combination in meeting the lubrication demands of OMC's 40 hp engine.

TABLE 1

| | OMC 40 HP ENGINE TESTS | | | | |
|---|---|---|---|---|---|
| Composition | F-1 | F-2 | F-3 | F-4 | F-5 |
| C-1[1] (vol. %) | 11 | — | — | 11 | 9.0 |
| C-2[2] (vol. %) | — | 20 | 13 | 7.5 | 7.5 |

TABLE 1-continued

| OMC 40 HP ENGINE TESTS | | | | | |
|---|---|---|---|---|---|
| Composition | F-1 | F-2 | F-3 | F-4 | F-5 |
| Remainder[3] (vol. %) | 89 | 80 | 87 | 81.5 | 83.5 |
| % Active Ingredient[4] (vol. %) | 9.4 | 10 | 6.5 | 13.1 | 11.4 |
| Result: | FAIL | FAIL | FAIL | PASS | PASS |

Notes:
[1]C-1 is double-bond isomerized octadecenyl succinimide having approximately 85% active ingredient.
[2]C-2 is polyisobutenyl (950 Mn) succinimide (a conventional detergent/dispersant) having approximately 50% active ingredient.
[3]Remainder contained conventional amounts of lubricity and flow improving agents in mineral oil.
[4]Approximate % active ingredient of C-1 and/or C-2 in formulation.

As can be seen from Table 1, only the formulations containing the additive combination of this invention (F-4 and F-5) passed the engine tests. Thus, the synergistic effect of this invention is clearly demonstrated by the unexpected engine passes achieved by combining components C-1 and C-2, which when used in formulations separately, do not meet the performance criteria. Furthermore, this synergism is achieved at relatively the same active ingredient (a.i.) treat rates.

AQUATIC TOXICITY TESTS

The toxicity of samples to aquatic organisms was determined by evaluating the sample's effects on a test population of fish. Oil composition samples were maintained as a dispersion of small droplets. Controlled amounts of the samples were added to test chambers where the effects on the fish were observed. Test duration was ninety-six (96) hours.

Toxicity of the samples was recorded in terms of $LC_{50}$, which represents the Lethal Concentration at which 50% of the test population dies. Although there is no uniform criteria for toxicity labeling, degrees of toxicity generally fall within the following categories:

| $LC_{50}$ Value (ppm) | Category |
|---|---|
| ≦1 | Highly or Very Toxic |
| 1–10 | Toxic or Moderately Toxic |
| 10–100 | Harmful or Slightly Toxic |
| 100–1000 | No Risk or Practically Non-Toxic |
| >1000 | Non-Hazardous |

For purposes of demonstrating this invention, $LC_{50}$ values >1,000 are acceptable toxicity levels and considered a pass. Table 2 records $LC_{50}$ values measured for two components (C-3 and C-2) and two formulated 2-cycle engine oils (F-6 and F-7).

TABLE 2

| AQUATIC TOXICITY DATA | | | | |
|---|---|---|---|---|
| Sample: | C-3[1] | C-2[2] | F-6[3] | F-7[4] |
| $LC_{50}$ (ppm): | <62.5 | >1000[5] | 127 | >5000[5] |
| Toxicity[6]: | Harmful | Non-Hazardous | Practically Non-Toxic | Non-Hazardous |
| Result: | FAIL | PASS | FAIL | PASS |

Notes:
[1]C-3 is the condensation reaction product of isostearic acid, polyisobutenyl (950 Mn) succinic anhydride, and tetraethylene pentamine (a conventional detergent/dispersant) having approximately 95% active ingredient.
[2]C-2 is polyisobutenyl (950 Mn) succinimide (a conventional detergent/dispersant) having approximately 50% active ingredient.
[3]F-6 contained 8 vol. % of C-3, 7.5 vol. % of C-2, and conventional amounts of thickening agents and flow improver in mineral oil.
[4]F-7 contained 9.0 vol. % of C-1 (isomerized octadecenyl succinimide), 7.5 vol. % of C-2, and conventional amounts of lubricity agents and flow improver in mineral oil.
[5]Maximum concentration tested.
[6]Toxicity category as previously defined.

As can be seen from Table 2, the formulation containing the additive combination of this invention (F-7) performed far better than the formulation containing a combination of conventional detergent/dispersants (F-6).

Furthermore, the data in Tables 1 and 2 show that satisfactory engine performance and non-toxicity are achieved only in the lubricating compositions containing the additive combination of this invention.

What is claimed is:

1. A fuel lubricant mixture for two-cycle engines which consisting essentially of part of a two-cycle engine oil per 15–250 parts of fuel, the two-cycle engine oil consisting essentially of 50–94.5% by volume of a lubricating base oil having a viscosity of 10–1000 cSt at 40° C., the oil being a member of the group of synthetic ester oils, mineral oils, alkylene oxide polymer oils and silicone oils, 0.5–15 volume % of (a) a first dispersant being the reaction product of a double bond isomerized $C_{16}$–$C_{20}$ olefin, an alkenyl mono- or poly-carboxylic acid and a nitrogen containing compound and (b) 5–10 volume % of a second dispersant being a hydrocarbyl succinimide wherein the hydrocarbyl group has 60 to 350 carbon atoms.

2. The mixture of claim 1, wherein the olefin is octadecene.

3. The mixture of claim 1, wherein the second dispersant is polyisobutenyl succinimide prepared from polyisobutenyl succinic anhydride of about 70 to 128 carbon atoms.

4. The mixture of claim 3 wherein, the polyisobutenyl has an $M_n$ of 950.

* * * * *

UNITED STATES PATENT AND TRADEMARK OFFICE

CERTIFICATE OF CORRECTION

PATENT NO. : 5,516,444
DATED : May 14, 1996
INVENTOR(S) : L.H. Gaines, et al.

It is certified that error appears in the above-indentified patent and that said Letters Patent is hereby corrected as shown below:

Column 18:

In claim 1, line 33, delete "which", and at line 34, preceding the word "part", insert the word --one--.

Signed and Sealed this

Thirteenth Day of August, 1996

Bruce Lehman

*Attest:*

BRUCE LEHMAN

*Attesting Officer*

*Commissioner of Patents and Trademarks*